US005103919A

United States Patent [19]

Warren et al.

[11] Patent Number: 5,103,919

[45] Date of Patent: Apr. 14, 1992

[54] METHOD OF DETERMINING THE ROTATIONAL ORIENTATION OF A DOWNHOLE TOOL

[75] Inventors: Tommy M. Warren, Coweta; Warren J. Winters, Tulsa, both of Okla.

[73] Assignee: Amoco Corporation, Chicago, Ill.

[21] Appl. No.: 592,433

[22] Filed: Oct. 4, 1990

[51] Int. Cl.[5] ..... E21B 7/06; E21B 21/08

[52] U.S. Cl. ..... 175/45; 175/48; 175/61

[58] Field of Search ..... 175/40, 45, 48, 61, 175/73, 74; 166/113; 367/83-85

[56] References Cited

U.S. PATENT DOCUMENTS

| | | | |
|---|---|---|---|
| 2,142,559 | 1/1939 | Duus | 175/45 |
| 3,718,194 | 2/1973 | Hering et al. | 175/45 |
| 4,596,293 | 6/1986 | Wallussek et al. | 175/45 |
| 4,699,224 | 10/1987 | Burton | 175/61 |
| 4,899,833 | 2/1990 | Warren et al. | 175/45 |
| 4,948,925 | 8/1990 | Winters et al. | 175/48 |

*Primary Examiner*—David J. Bagnell
*Attorney, Agent, or Firm*—Marcy M. Lyles

[57] ABSTRACT

A method of determining the rotational orientation of a downhole tool on a rotatable conduit, such as a collar on a drillstring in a borehole, without interrupting the rotation of the drillstring, includes establishing the initial rotational orientation of the downhole tool; creating a pressure change to generate a signal; providing a reference point on the conduit; generating a reference signal each time the reference point rotates past a detector; generating the signal each time the conduit rotates through the defined rotational orientation with respect to the tool; and timing and comparing the occurrences of the referenced signal and the signal in order to monitor the rotational orientation of the downhole tool.

10 Claims, 8 Drawing Sheets

METHOD OF DETERMINING THE ROTATIONAL ORIENTATION OF A DOWNHOLE TOOL

BACKGROUND OF THE INVENTION

1. Field of the Invention

The present invention relates to methods for rotationally orienting a downhole tool and, more particularly, but not by way of limitation, the invention relates to rotationally orienting such a downhole tool during directional drilling.

2. Setting of the Invention

In order to enhance the recovery of subterranean fluids, such as oil and gas, it is sometimes desirable to steer or direct a borehole towards a target that is not directly below the position of the well on the earth's surface. For example, in an oil producing formation which has little vertical depth and relatively greater horizontal extent with respect to the surface of the earth, a borehole which extends horizontally through the oil producing formation can produce more oil than one extending vertically through the formation.

In order to directionally drill a borehole horizontally, or at any selected angle, it is necessary to be able to steer the rotating drill bit. Numerous devices have been patented for this task. However, one such device is described in U.S. Pat. No. 4,699,224 which discloses one such apparatus and method which uses a flexible drillstring connected by a flexible joint to a reamer body and has a drill bit connected to an end thereof. An eccentric cylindrical collar is connected circumferentially at the downhole end of the flexible drillstring over the flexible joint connected to the reamer body. This causes the drill bit to pivot about the stabilizer in the opposite direction of the displacement created by the eccentric collar, thus the drill bit's trajectory can be altered or steered.

A borehole engaging mechanism is mounted to the outside surface of the thicker wall of the eccentric collar and digs into the borehole wall to prevent clockwise rotation of the eccentric collar. When the drillstring is rotated clockwise it rotates freely within the eccentric collar, but when it is rotated counterclockwise a springbiased latch mechanism latches the eccentric collar to the drillstring and causes the eccentric collar to rotate with the drillstring. This allows the eccentric collar to be rotationally reoriented with respect to the borehole.

Although the borehole engaging mechanism is designed to prevent the cylindrical eccentric collar from rotating with the drillstring during drilling, friction between the eccentric collar and the drillstring, together with downhole vibration and movement occurring during drilling, will tend to rotate the collar; thereby resulting in the need to reorient the eccentric collar periodically.

U.S. Pat. No. 4,948,925 describes a signalling device that can be used with the apparatus disclosed in U.S. Pat. No. 4,659,224 to generate a pressure pulse whenever the drillstring is radially, or rotationally oriented, at a preselected point on a collar or deflection tool. The signalling device is used to signal the orientation of the eccentric collar so that the borehole can be drilled in a desired direction. The normal operating procedure is to establish an initial orientation of a reference point near the lower end of the drillstring with a commercially available orientation technique, such as one using a mule shoe and either magnetic or gyroscopic surveying, as are well known in the art. The mule shoe is radially aligned with the latch on the drillstring at the time the drillstring is run into the borehole. After the survey is recorded, a reference mark is made on the drillstring or rotary table, to reference the position of the mule shoe and thus the latch. Since the rotational orientation of a collar recess with respect to the eccentricity is known, the rotational orientation of the eccentric collar with respect to the drillstring is known, and thus the reference mark on the drillstring can be observed to indicate the direction that the bit is being steered.

After a period of drilling (clockwise rotation), the drillstring can be raised slightly and the drillstring rotated counterclockwise to observe a pressure decrease when the orifice in the collar and orifice in the drillstring are aligned, i.e., when the latch is radially coincident with the recess. Since the latch is then aligned with the recess in the eccentric collar, the orientation of the reference mark at the surface can be interpreted to determine if the rotational orientation of the eccentric collar in the borehole has changed during the previous drilling period. Generally the orientation is observed while rotating both clockwise and counterclockwise to account for twist in the drillstring.

Problems with the previously described apparatus and procedure have occurred in that the procedure requires that drilling be interrupted to check its orientation. This interruption is required to raise the drill string, rotate the drillstring counterclockwise, observe the pressure pulse when the latch assembly opens, and determine whether the eccentric collar needs to be reoriented. These interruptions last for about three to eight minutes each and result in an inefficient drilling process, especially if it is found that no eccentric collar reorientation is needed. In some cases the verification process itself may disturb the orientation of the eccentric collar. Additionally, if it is found that the collar has moved, the amount of drilling that has occurred at unknown orientations and angles since the last verification of the proper positioning of the collar can not be determined.

Therefore, there is a need for an apparatus and method which will indicate the orientation of a downhole tool, such as an eccentric collar, without interrupting the drilling operation.

SUMMARY OF THE INVENTION

The present invention is contemplated to overcome the foregoing deficiencies and meet the above-described needs. For accomplishing this, the present invention provides a novel and improved method for determining the rotational orientation of a downhole tool.

The method includes establishing the initial rotational orientation of a downhole tool with respect to a reference point on a conduit; generating a signal when the conduit is in a defined rotational orientation with respect to the tool; and monitoring the rotational orientation of the rotating conduit at which the signal occurs.

The signal is generated by changing the geometry of the fluid flow path through the conduit when the conduit is in the defined rotational orientation with respect to the tool; flowing fluid through the conduit; and sensing the response of the flowing fluid to the change in geometry of the fluid flow path to generate the signal. More preferably, the signal is generated by pumping fluid through the conduit; changing the size of the fluid flow path through the conduit when the conduit is in the defined rotational orientation with respect to the tool in order to create a pressure change in the flowing fluid; recording a pressure profile of the pumped fluid when the conduit is not rotating; recording a pressure profile of the pumped fluid when the conduit is rotating; and comparing the pressure profiles to generate the signal(s).

Preferably, the rotational orientation of the rotating conduit at which the signal occurs is monitored by providing a reference point on the conduit; providing a stationary detector at a known orientation for a conduit reference point; determining the angular displacement of the reference point relative to the initial rotational orientation of the tool and conduit at which the signal is generated; and monitoring the angular displacement as the conduit rotates in order to monitor the rotational orientation of the tool. More preferably, a reference signal is generated each time the reference point and conduit complete 360° of rotation and the angular displacement between the reference signal and the signal is monitored in order to monitor the rotational orientation of the tool.

BRIEF DESCRIPTION OF THE DRAWINGS

The present invention will be better understood by reference to the examples of the following drawings.

DETAILED DESCRIPTION OF THE PREFERRED EMBODIMENTS

Figure 1:
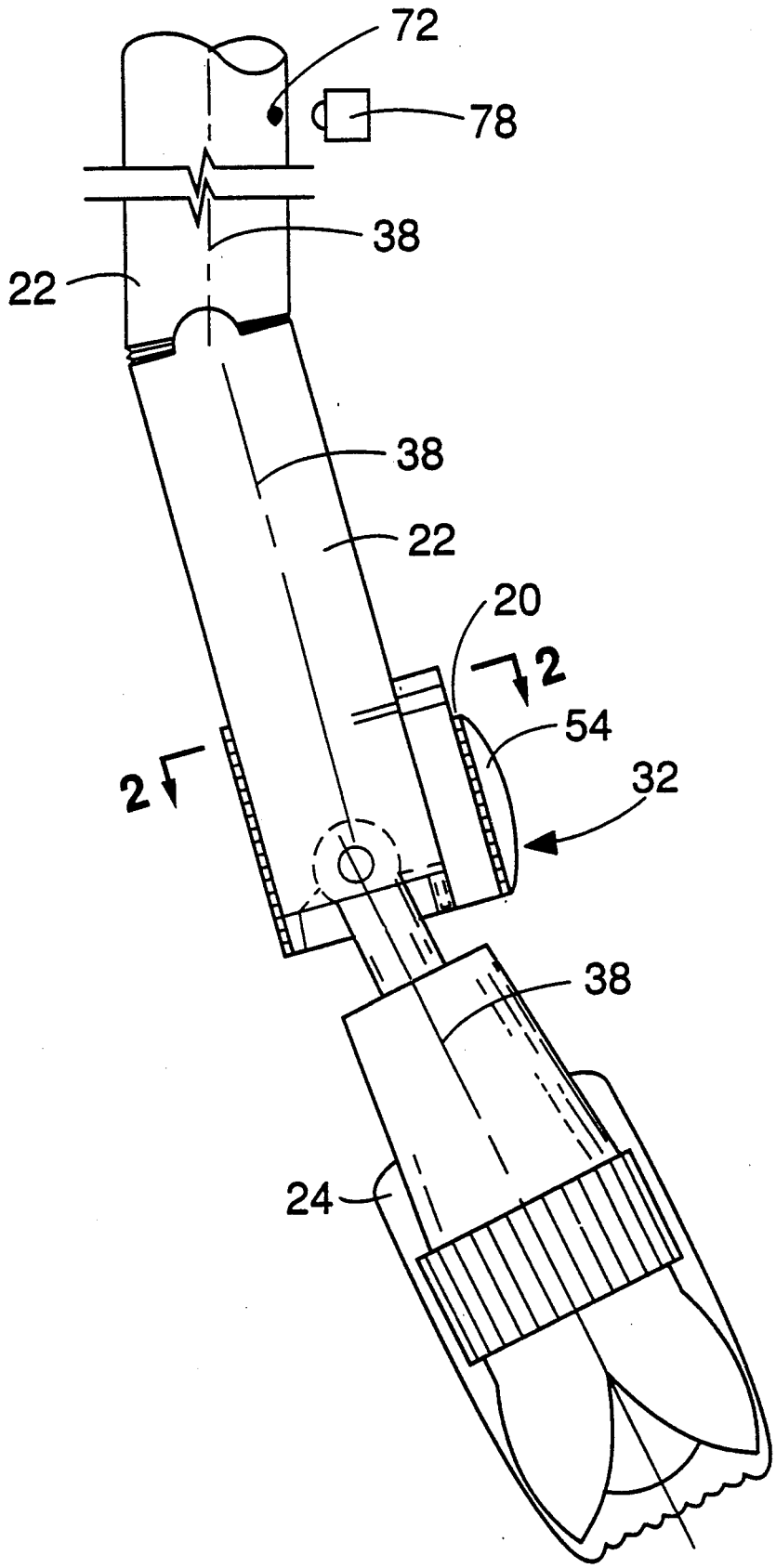
FIG. 1 is a partially sectioned side view of an embodiment of a downhole, tool connected on a rotatable conduit of the invention.
Figure 2:
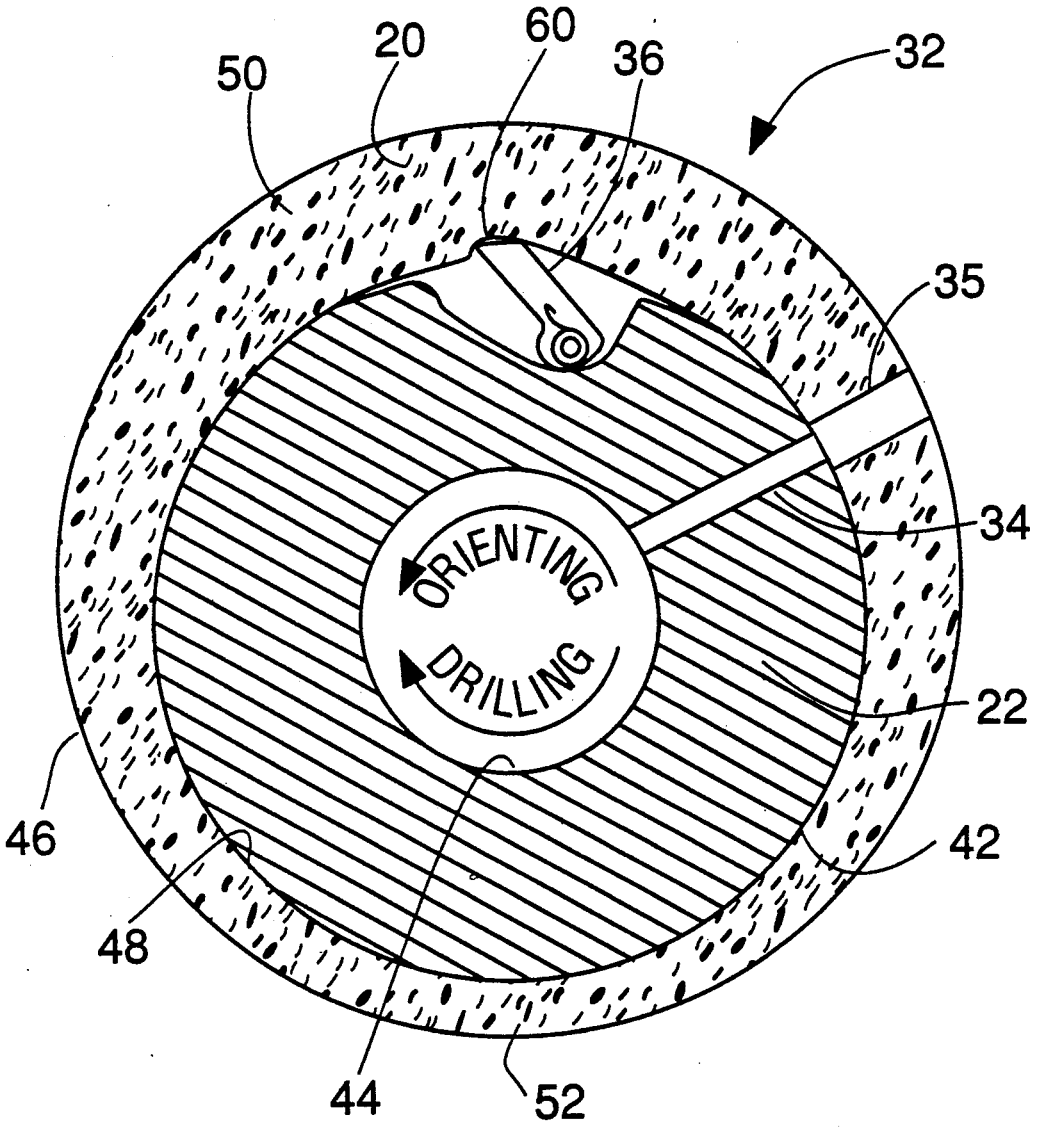
FIG. 2 is a view taken along line 2—2 of FIG. 1.

FIGS. 1-2 present embodiments of downhole tools used in the method of determining the rotational orientation of a downhole tool 20 on a rotatable conduit 22, such as a drillstring 22. As exemplified in FIG. 1, in the preferred embodiment, the downhole tool 20, such as a collar, is connected to the drillstring 22 in the borehole 24 of an oil or gas well, although it is intended to be understood that the method can be used to rotationally orient virtually any type of tool or collar on any type of rotatable conduit in virtually any type of environment, e.g., water wells, steam wells, underwater conduit or pipe, surface installations of conduit, etc.

Referring to the example of FIG. 1, the method of the present invention can be generally described as including establishing the initial rotational orientation of a reference point to a surface drillstring reference point; generating a signal 26 (best exemplified in FIGS. 5-6) when the conduit 22 is in a defined rotational orientation with respect to the collar 20; monitoring the rotational orientation of the rotating conduit 22 at which the signal 26 occurs; and calculating the orientation of the collar 20 with respect to true North. By rotational orientation is meant the angular displacement of a point on the collar 20 or conduit 22 with respect to a reference point which does not rotate with the collar 20 or conduit 22, such as a reference point on the earth which is at a known direction with respect to true North.

Preferably, the signal 26 is generated by changing the size or structural characteristics of the fluid flow path through the conduit 22 when the conduit 22 is in the defined rotational orientation with respect to the collar 20 and sensing the response of the flowing fluid to the change in size or characteristics of the fluid flow path to generate the signal 26. The signal 26 can then be provided by sensing the changes in the flow or pressure of the fluid in the conduit 22. Commercially available flow or pressure sensing devices or transmitters (not illustrated can be used to sense and transmit the flow or pressure changes as is well known in the art. Preferably, the signal 26 is provided by changing the fluid pressure in the conduit 22 and, more preferably, is provided by decreasing the fluid pressure in the conduit 22 and sensing the fluid pressure decrease, as further discussed below.

More preferably, referring to the example illustrated in FIG. 2, the signal 26 is created by providing an orifice 34 through the wall of the conduit 22, providing an orifice 35 through the collar 20, pumping fluid through the conduit 22 and discharging fluid through orifice 34 and orifice 35 when the conduit 22 is in a defined rotational orientation with respect to the collar 20 to create a pressure decrease in the flowing fluid and thereby to generate a signal.

In the preferred embodiment, the signal 26 is generated using an orienting apparatus 32 which includes an orifice 34 through the wall of the conduit 22 and an orifice 35 through the wall of the collar 20. The collar 20 and conduit 22 are rotatable relative to one another about the longitudinal axis 38 of the conduit 22. A latch 36 is used for latching the collar 20 to the conduit 22, when orifices 34 and 35 are aligned and rotating the collar 20 when the conduit 22 is rotated in a first direction ("orienting") about the longitudinal axis 38 of the conduit 22. Conversely, the latch 36 is used for unlatching the collar 20 from the conduit 22 and allowing the conduit 22 to rotate relative to the collar 20 when the conduit 22 is rotated in a second opposite direction ("drilling") about the longitudinal axis 38 of the conduit 22. For most purposes, the first "orienting" direction is counterclockwise and the second "drilling" direction is clockwise.

The collar orienting apparatus 32 is coaxially and rotatably mounted on the outside surface 42 of the conduit 22 with the fluid flowing within the inside surfaces 44 of the conduit 22. Further, the collar 20 has an outside surface 46 and an inside surface 48 with an eccentric collar, i.e., the collar 20 is a cylindrical sleeve with a cylindrical hole passing longitudinally therethrough and the axis of the hole being intentionally displaced to one side of the central axis of the collar 20. The resulting offset creates a relatively thick wall 50 on one side of the collar 20 and a relatively thin wall 52 on the other opposite side of the collar 20. A borehole engaging mechanism 54 is mounted on the outside surface 46 of the thick wall 50 of the collar 20 and the latch 36 latches to the inside surface 48 of the thick wall 50 of the collar 20, opposite the borehole engaging mechanism 54.

Referring to the example illustrated in FIG. 2, the collar orienting apparatus 32 includes a recess 60 in the inside surface 48 of the collar 20. The recess 60 and the latch 36 are radially coincident with respect to the longitudinal axis of the conduit 22 at least once during each rotation of the conduit 22 relative to the collar 20. Being radially coincident means that the recess 60 and the latch 36 coincide on the same radius extending from the longitudinal axis 38. Preferably, the latch 36 and recess 60 also rotate in the same radial plane with respect to the longitudinal axis 38.

As exemplified in FIG. 2, the collar includes a sealing surface 48 for sealing the orifice 34 when the orifice 34 and orifice 35 are not radially coincident. In other words, when the conduit 22 is in the defined rotational orientation with respect to the collar 20, the latch 36 and recess 60 are radially coincident so that orifice 34 and orifice 35 are also radially coincident. When the latch 36 and recess 60 are not in the defined rotational orientation and not radially coincident, the inside surface 48 of the collar 20 effectively seals the orifice 34. The latch 36, orifice 34, orifice 35 and recess 60 are designed so that the orifice 34 and orifice 35 are aligned any time the conduit 22 is in the defined rotational orientation with respect to the collar 20, regardless of which direction the conduit 22 is rotating. Consequently, anytime the conduit 22 rotates into or through the defined rotational orientation, the two aligned orifices 34 and 35 will allow fluid passage to create a pressure pulse, or signal 26. Further description of various embodiments of the preferred collar orienting apparatus 32 and method can be found in U.S. Pat. No. 4,948,925.

Figure 3:
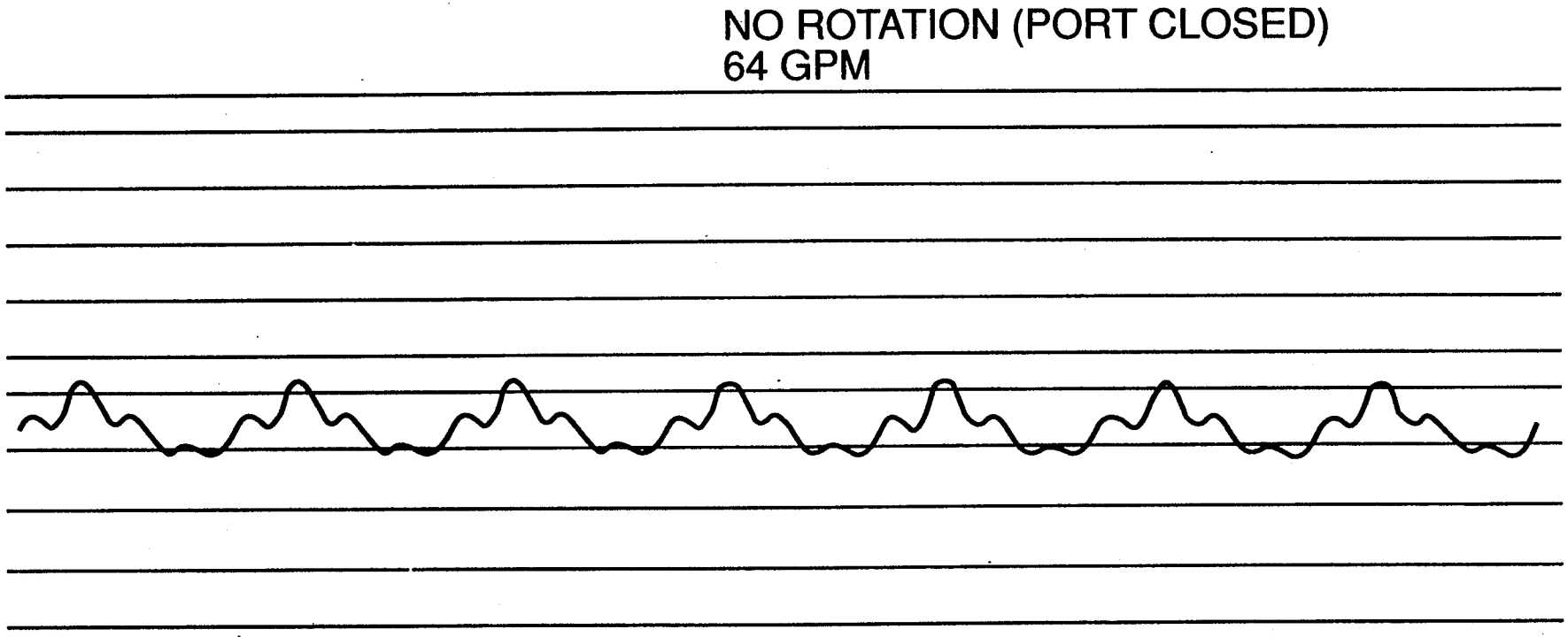
FIG. 3 is a plot of fluid pressure versus time of drilling fluid being pumped through a drill string when the drillstring is no rotating and the orifice in the drillstring and in the tool are not aligned.
Figure 4:
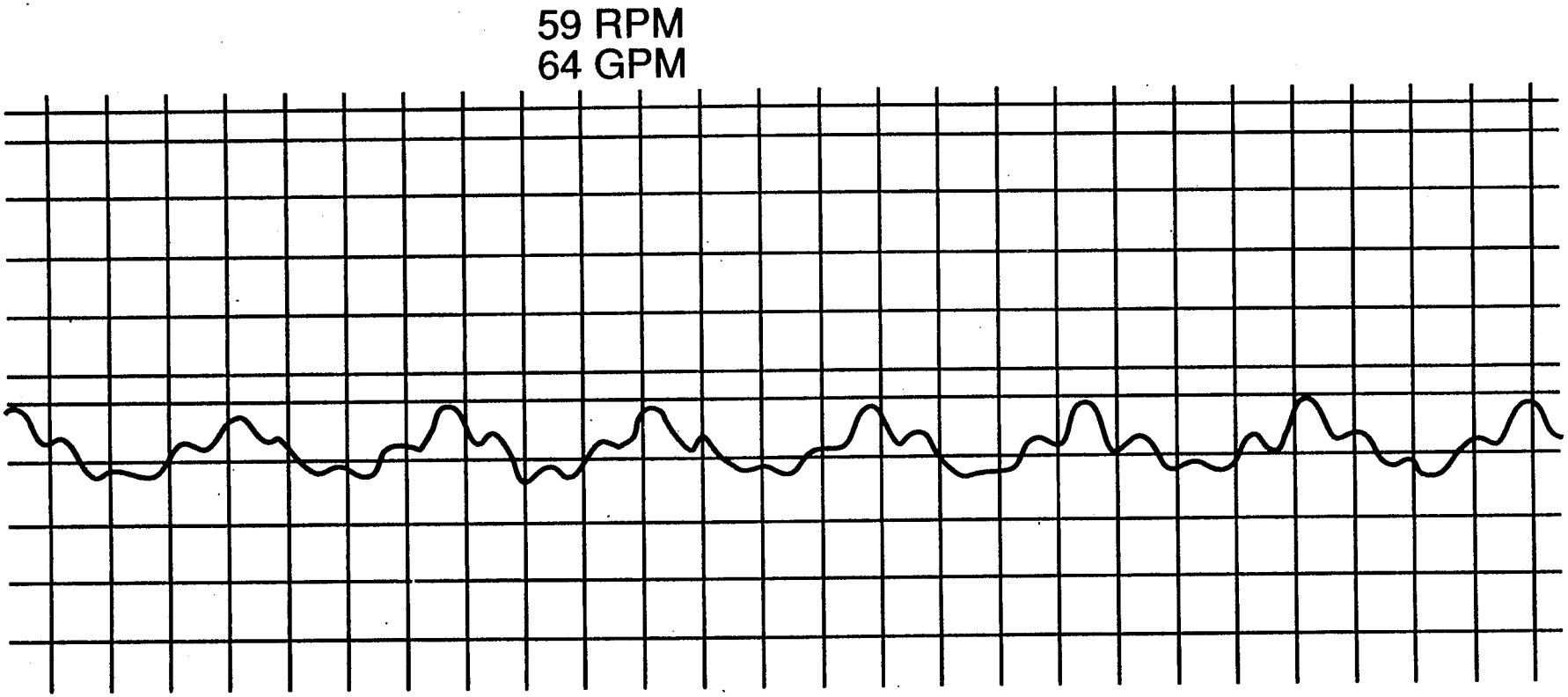
FIG. 4 plots pumped drilling fluid pressure versus time when the drill string is rotating and when the drillstring includes an embodiment of the tool orienting apparatus of the present invention.
Figure 5:
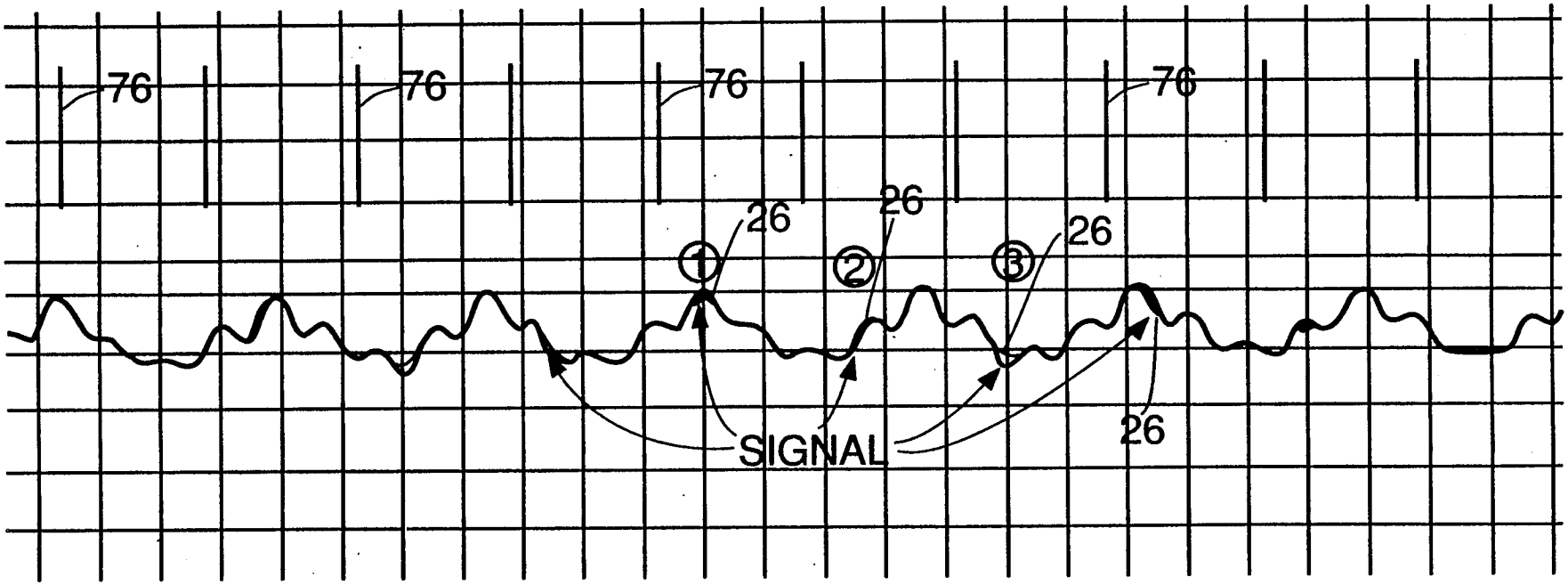
FIG. 5 is an overlay of FIG. 3 on FIG. 4.
Figure 6:
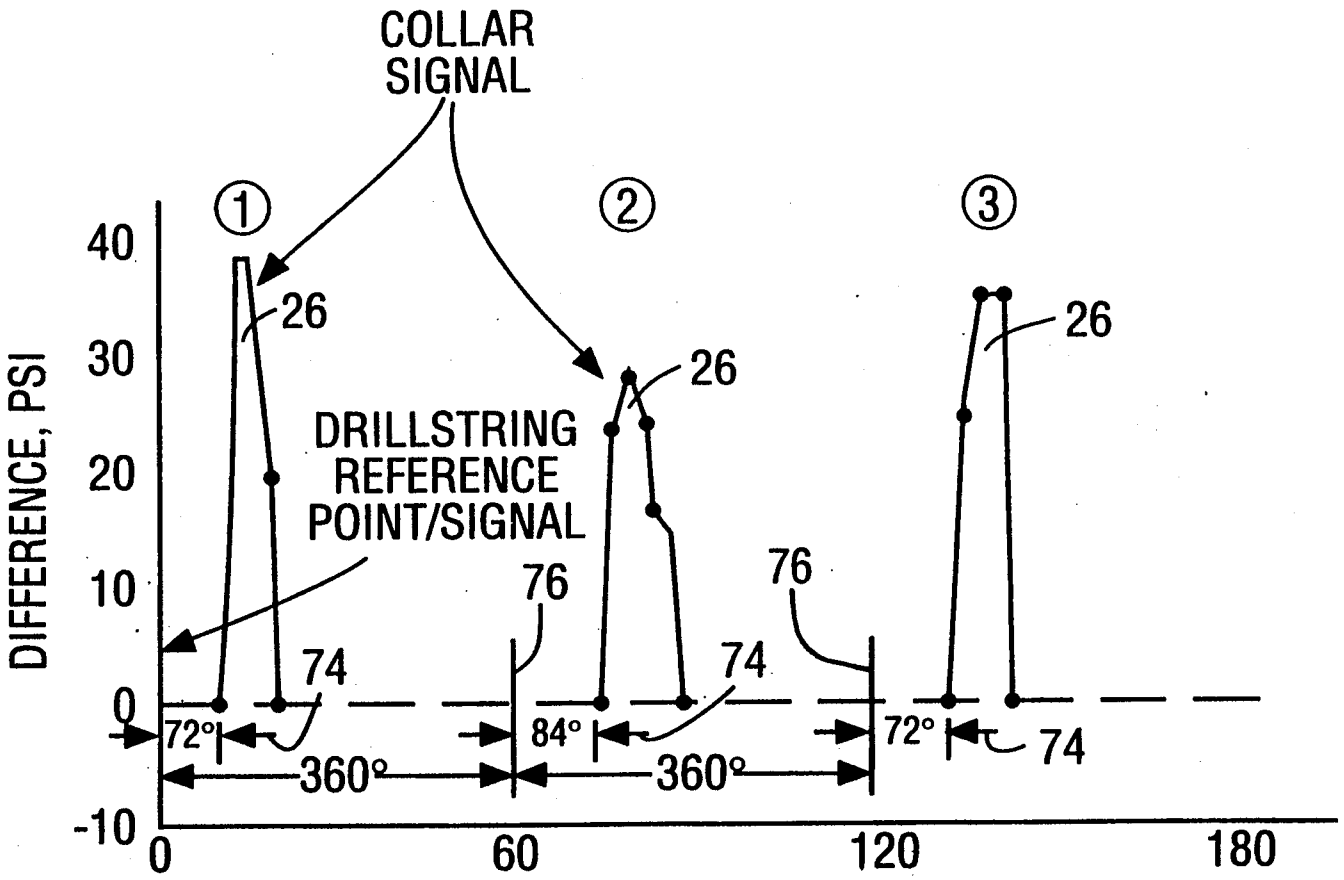
FIG. 6 illustrates an embodiment of the signal of the present invention obtained by subtracting FIG. 3 from FIG. 4.

In the preferred embodiment, the signal is generated by pumping pressurized fluid through the conduit 22 and through the collar orienting apparatus 32; recording a pressure profile or pressure history (also known as a "pump signature") of the pumped fluid when the conduit 22 is not rotating, as is well known in the art and as exemplified in FIG. 3; recording a pressure profile of the pumped fluid when the conduit is rotating, as exemplified in FIG. 4; and comparing the pressure profiles to generate the collar signal 26, as illustrated in FIGS. 5 and 6.

FIG. 4 shows a recording of the fluid pressure in a drillstring versus time while drilling with the drillstring 22 rotating at 60 revolutions per minute (rpm). The predominant pressure variations on FIG. 4 are the pressure fluctuations caused by the cyclic motion of the plungers and valves in the pump used for the test.

FIG. 3 is a recording of the fluid pressure versus time when the pump is operating and the drillstring 22 is not rotating. FIGS. 3 and 4 appear to be very similar until the FIGS. are overlain, as illustrated in FIG. 5, and the divergence identified. Since the divergence identifies the signal 26, the divergence is indicated by reference number 26 on FIG. 5.

The pump profiles of FIGS. 3 and 4 can also be subtracted, as is well known in the art, to make the signal 26 more evident as exemplified in FIG. 6. The three collar signals 26 identified in FIG. 6 correspond to the signals 26 on FIG. 5. A pump timing signal, i.e., a signal generated at the same point in each cycle of the pump, can be used to facilitate placing the two pressure profiles in phase before they are subtracted. The detection of the signal 26 can be determined from a simple trigger level (magnitude of the difference in the two profiles) above the baseline difference or the difference signal can be differentiated to provide a more distinct inflection point for detection, i.e., to exaggerate the slope or rate of change in the difference between the pressure profiles. When an apparent signal 26 is detected, it can be integrated and compared to the integral of the expected collar signal in order to help identify false signals 26. This differentiation and integration of the signals are examples of well known techniques which can be used for identifying the signal 26 in its "noisy" environment. Other techniques for identifying the signal 26 would be known to one skilled in the art in view of the disclosure contained herein.

If a computer is used to implement the method of the present invention, it may be desirable to record and average the fluid pressure over several cycles of the pump while the drillstring 22 is not rotating to obtain a more accurate pump signature. It can also be desirable to use the computer to proportionately expand or contract the measured pump profile (along either axis) in order to eliminate potential mismatches caused by slight variations in either the pump cycle speed and/or fluid pressure fluctuations in the drillstring 22.

Referring to FIG. 1, in the preferred embodiment, the rotational orientation of the rotating conduit 22 at which the collar signal 26 occurs is monitored by providing a reference point 72, or reference mark 72, on the conduit 22; determining the angular displacement 74 (best seen in FIG. 6) of the reference point 72 relative to the initial rotational orientation of the collar 20 and conduit at which the signal 26 is generated; and monitoring or measuring the angular displacement of the reference point 72 relative to the initial rotational orientation of the collar 20 and conduit 22, i.e., monitoring the angular displacement of the reference point 72 with respect to the signal 26 as the conduit 22 rotates in order to monitor the rotational orientation of the collar 20.

More preferably, the rotational orientation of the rotating conduit 22 at which the signal 26 occurs is monitored by generating a reference signal 76 each time the reference point 72 and conduit 22 complete 360° of rotation; generating a signal 26 each time the rotating conduit 22 is in the defined rotational orientation with respect to the collar 20; and monitoring the angular displacement 74 between the reference signal 76 and the signal 26, as exemplified in FIG. 6, to monitor or measure the rotational orientation of the collar 20.

Referring to the example of FIG. 6, the time between reference signals 76 corresponds to 360° of rotation of the conduit 22 and a signal 26 should occur with every 360° of rotation; the time or angular displacement between the signal 26 and the reference signal 76 should remain the same unless the rotational orientation of the collar 20 with respect to the borehole 24 has changed. Therefore, the time between the reference signal 76 and the signal 26 can be used to calculate the angular displacement 74 of the collar 20 and eccentric collar 20 (since the position of the eccentric collar 20 relative to the recess 60 in collar 20 is known) relative to the reference point 72 and thereby to monitor any changes in the position of the eccentric collar 20 with respect to the borehole 24.

The operation of the method of determining the rotational orientation of a downhole tool on a rotatable conduit, such as an eccentric collar 20 on a drillstring 22 in a borehole 24, without interrupting the rotation of the drillstring 22 will now be described in more detail. First, the initial rotational orientation of the latch 36 and a reference point, such as the mule shoe sub, near the bottom of the drillstring 22 is established while tripping the drillstring 22 into the borehole. If flexible collars are being used, this reference point is established with the flexible collars undergoing a clockwise torsional loading. After the drillstring 22 is tripped into the borehole, a conventional technique such as magnetic or gyroscopic surveying is used to determine the orientation of the mule shoe sub. A reference point 72 is made on the drillstring 22 to reference the orientation of the mule shoe sub. Normally, the reference point 72 may be made on the rotary table of the drilling rig (not illustrated) at the surface of the earth since the rotary table rotates with the drillstring 22 but does not change elevational position with respect to the surface of the earth as does the drillstring 22. A detector 78 is located at a stationary point near the reference point 72 so that the detector 78 can generate a distinct reference signal 76 each time the reference point 72 and conduit 22 rotate past the detector 78. The orientation of the detector 78 from the centerline of the conduit 22 relative to a selected azimuthal point, such as true North, is determined. Preferably, the reference point 72 is a ferromagnetic material and the detector 78 is a magnetic detector.

Once the orientation of the collar latch 36 is established relative to the mule shoe, and the mule shoe orientation relative to the surface reference point 72 is established, the drillstring 22 can be rotated counterclockwise to rotationally orient, i.e., to position the eccentric collar 20 as needed. As previously discussed, when the drillstring 22 is rotated counterclockwise the latch 36 engages recess 60 and rotates the collar 20 with the drillstring 22. Once the eccentric collar 20 is properly positioned, the drillstring 20 can be rotated clockwise to free the latch 36 from recess 60 and commence drilling. As previously discussed, a distinct signal 26 is generated each time the drillstring 22 rotates through the defined rotational orientation with respect to the collar 20, i.e., each time the latch 36 encounters recess 60 orifice 34 is aligned with orifice 35 and a pressure decrease is generated in the drilling fluid. The rotational orientation of the eccentric collar 20 is then monitored by timing and comparing the occurrences of the reference signal 76 and signal 26. The orientation of the collar 20 with respect to true North is determined from its orientation relative to the reference signal 76 and the known direction of detector 78.

Since a finite time is required for the signal to travel from the collar 20 to the surface, the relative position of the surface reference mark must be adjusted to account for its clockwise rotation while the collar signal 26 is traveling from the collar 20 to the earth's surface. Similarly, an adjustment must be made for wind-up or twist in the drillstring due to changes in the torsional load on the bit. If the position, or rotational orientation, of the eccentric collar 20 changes in the borehole 24 such position will also change with respect to the initial orientation of the reference point 72 and reference signal 76. The signals can be recorded, as exemplified in FIGS. 4–6, to continuously monitor the rotational orientation of the eccentric collar 20 without interrupting rotation of the drillstring 22. Thus, it can be seen that the present method greatly improves drilling efficiency and borehole trajectory control by providing a more accurate knowledge of the rotational orientation of the eccentric collar 20 at all times.

The method can also be implemented using a computer to time and compare the occurrences of the reference signal 76 and the signal 26, and to automatically provide an update of the rotational orientation of the eccentric collar 20 with each revolution of the drillstring 22, or at any lesser frequency as desired. The computer is programmed to provide a continuously updated history of the rotational orientation of the eccentric collar 20. This history should be monitored so that drilling can continue uninterrupted until the rotational orientation of the eccentric collar 20 has changed sufficiently to require a repositioning of the eccentric collar 20.

The above-described orientation method is based upon determining the orientation of the drillstring at the surface when a signal arrives, by knowing the travel time of the signal, and by knowing the magnitude of twist , measured in degrees, in the drillstring. The twist can also be calculated from well known theoretical relationships, if the torque is known. From these inputs, the downhole orientation of the tool at the time the signal was generated can be determined. The signal travel time can be calculated from the sonic velocity in the mud inside the drillstring 22. There are well-known theoretical relationships between the sonic velocity, drillstring geometry and mechanical properties, and the fluid properties. However, in the preferred embodiments of the present invention, the drillstring 22 is composed of many different geometries (including a pliable hydraulic hose in wiggly drill collars) and the mud properties may not be exactly known, it would be better if the sonic velocity could be directly measured.

If the drillstring 22 is rotated at various speeds, the arrival of the signal 26 will shift with respect to the surface orientation. For example, in FIG. 7 the arrival of the signal 26 is shown for three different rotational speeds. The orientation of the eccentric collar 20 has not changed for each of these three measurements. At 15 rpm the signal 26 arrives 2.33 sec after the surface reference mark, at 30 rpm it arrives 1.33 sec after the surface mark, and at 60 rpm is arrives 0.83 sec after the surface reference mark. If this data is plotted as shown in FIG. 8, both the static orientation of the tool and the delay factor for the sonic travel time can be determined, by using well known techniques.

The twist can also be directly measured at the wellsite by monitoring the shift of the surface signal 26 as the torque changes. A linear relationship between twist and torque can be determined by applying weight to the bit and simultaneously measuring the signal shift and torque. This linear relationship can then be used to correct the measured signal arrival for twist while drilling.

Figure 7:
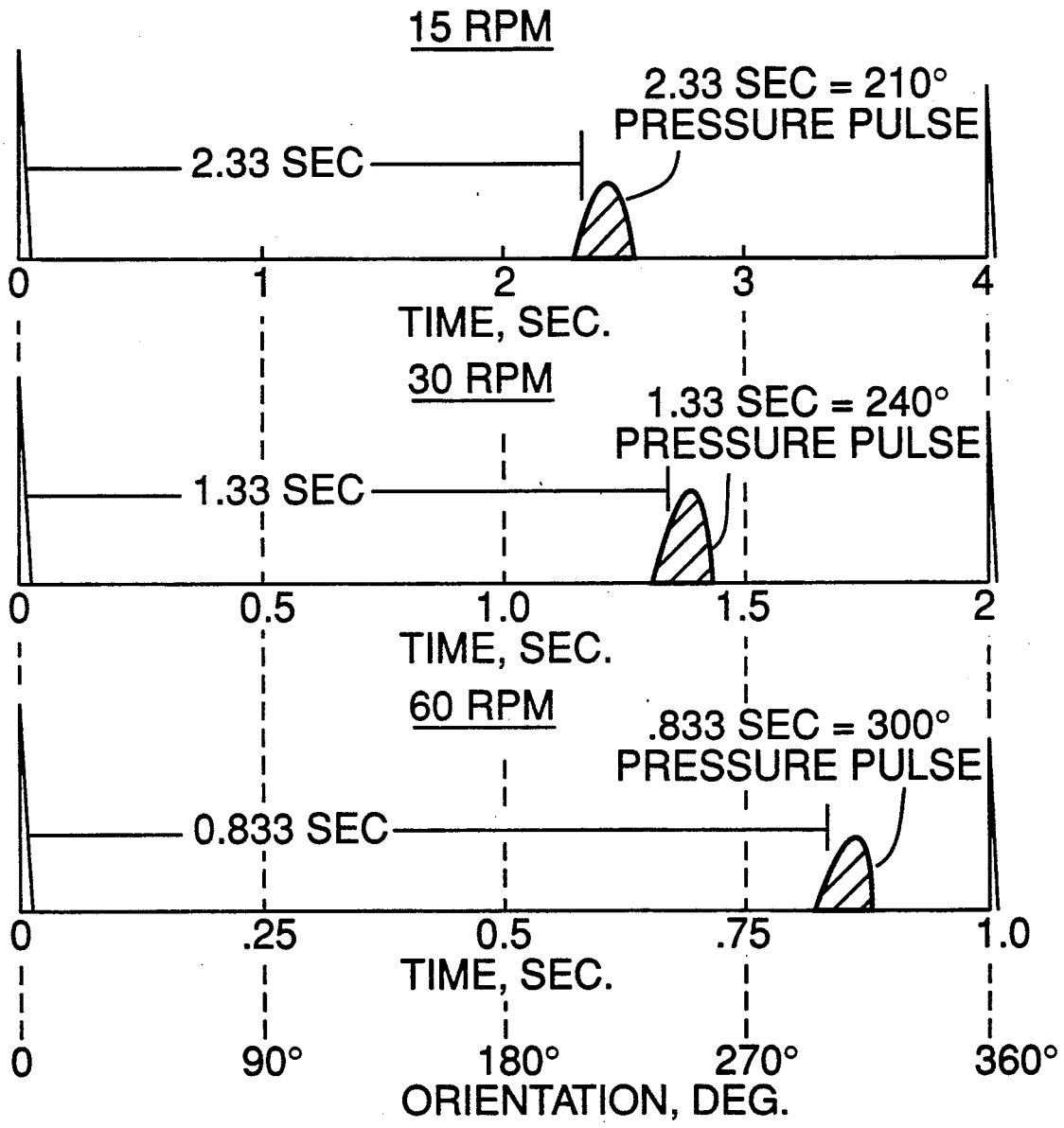
FIG. 7 is an illustration of the delay of the signal with respect to the rotary timing mark at rotational speeds of 15, 30, and 60 rpm.
Figure 8:
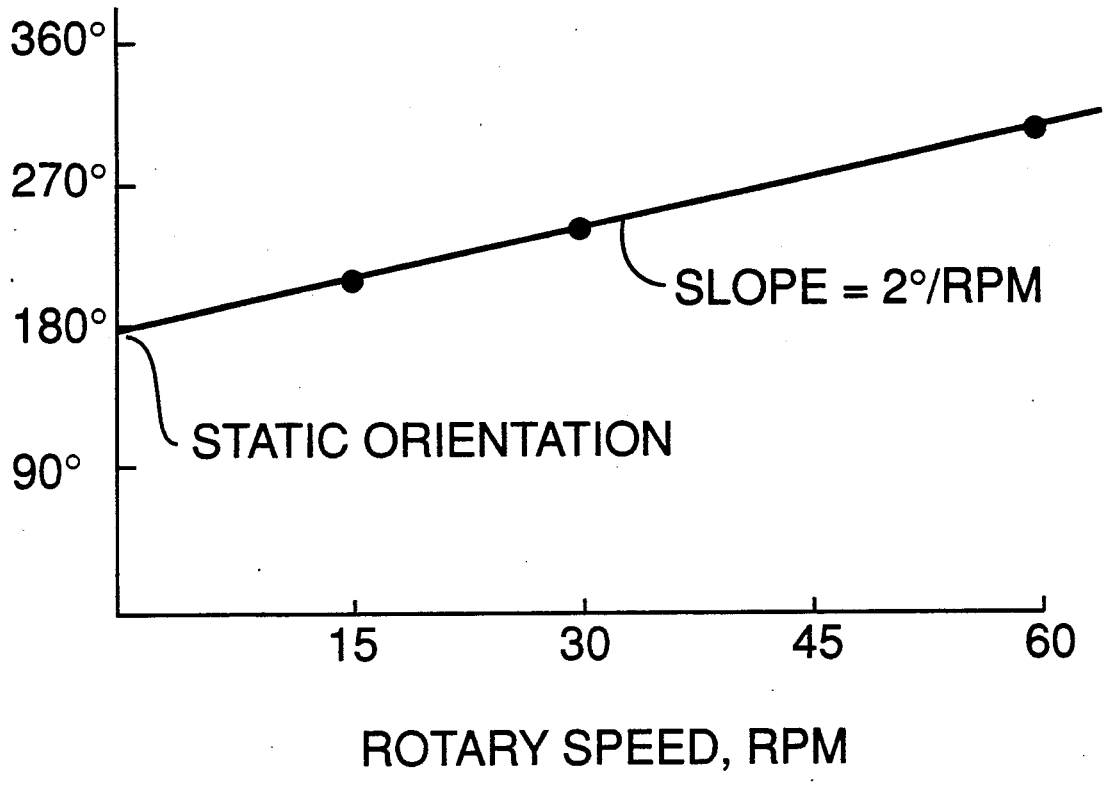
FIG. 8 is a plot of the angular position of the signal with respect to a reference point at rotational speeds of 15, 30, and 60 rpm.

Implementation of a correction procedure for signal delay can be accomplished by lowering the drillstring into the wellbore until the drill bit enters the top of the proposed curve; rotating the drillstring at several rotary speeds; recording the arrival of the signal at each rotary speed; calculating the best fit slope and intercept data using well known methods; and using the slope and any new measured rotational speed to adjust subsequent orientation signals for the sonic delay time, as shown in FIGS. 7 and 8.

Implementation of the correction procedure for drillstring twist can be accomplished by lowering the drillstring into the wellbore until the drill bit enters the top of the proposed curve; rotating the drillstring; applying weight to the drill bit of several different magnitudes; recording the arrival of the signal and the torque at each such weight; calculating the linear relationship between the torque and signal shift using well known methods; and using the linear slope and any new measured torque to adjust subsequent orientation signals for the drillstring twist, as shown in FIGS. 7 and 8.

While presently preferred embodiments of the invention have been described herein for the purpose of disclosure, numerous changes in the construction and arrangement of parts and the performance of steps will suggest themselves to those skilled in the art, which changes are encompassed within the spirit of this invention as defined by the following claims.

What is claimed is:

1. A method of monitoring the rotational orientation of a downhole tool on a rotatable conduit without interrupting drilling, comprising:
(a) establishing an initial rotational orientation of the downhole tool with respect to a reference point on the rotatable conduit;
(b) generating a signal when the rotating conduit is in a defined rotational orientation with respect to the downhole tool during drilling; and
(c) monitoring the rotational orientation of the rotating conduit at which the signal occurs.

2. A method of claim 1 in which step (b) comprises:
changing the size of a fluid flow path through the rotating conduit when the rotating conduit is in the defined rotational orientation with respect to the downhole tool;
flowing fluid through the rotating conduit; and
sensing the response of the flowing fluid to the change in size of the fluid flow path to generate the signal.

3. A method of claim 1 in which step (c) comprises:
determining the angular displacement of the reference point relative to the initial rotational orientation of the downhole tool and rotatable conduit at which the signal is generated; and
monitoring the angular displacement as the conduit rotates in order to monitor the rotational orientation of the downhole tool.

4. A method of claim 3, and including:
generating a reference signal each time the reference point and conduit complete 360 degrees of rotation;
generating a signal each time the rotating conduit is in the defined rotational orientation with respect to the downhole tool; and
monitoring the angular displacement between the reference signal and the signal in order to monitor the rotational orientation of the downhole tool.

5. A method of monitoring the rotational orientation of a downhole tool on a rotatable conduit without interrupting drilling, comprising:
(a) establishing an initial rotational orientation of the downhole tool with respect to a reference point on the rotatable conduit;
(b) generating a signal when the rotating conduit is in a defined rotational orientation with respect to the downhole tool during drilling, comprising:
pumping fluid through the conduit;
changing the size of the fluid flow path through the conduit when the conduit is in the defined rotational orientation with respect to the downhole tool in order to create a pressure change in the flowing fluid;
recording a pressure profile of the pumped fluid when the conduit is not rotating;
recording a pressure profile of the pumped fluid when the conduit is rotating; and
comparing the pressure profiles; and
(c) monitoring the rotational orientation of the rotating conduit at which the signal occurs.

6. A method of monitoring the rotational orientation of a downhole tool on a rotatable conduit without interrupting drilling, comprising:
(a) establishing an initial rotational orientation of a reference point on the downhole tool with respect to the conduit;
(b) flowing fluid through the conduit;
(c) changing the size of the fluid flow path through the conduit when the conduit is in a defined rotational orientation with respect to the downhole tool during drilling;
(d) sensing the response of the flowing fluid to change in size in the fluid flow path to generate a signal;
(e) providing a reference point on the conduit;
(f) generating a reference signal each time the reference point rotates past a detector during drilling;
(g) generating the signal each time the rotating conduit rotates through the defined rotational orientation with respect to the downhole tool during drilling; and
(h) monitoring the angular displacement between the reference signal and the signal in order to monitor the rotational orientation of the downhole tool.

7. A method of determining the rotational orientation of a downhole tool on a rotatable conduit without interrupting rotation of the conduit, comprising:
(a) establishing an initial rotational orientation of the downhole tool;
(b) providing a conduit orifice through a wall of the conduit;
(c) providing a tool orifice through a wall of the downhole tool;
(d) pumping fluid through the conduit and orifice;
(e) aligning the conduit orifice nd tool orifice when the conduit is in a defined rotational orientation with respect to the downhole tool in order to create a pressure change in the flowing fluid and to generate a signal;
(f) providing a reference point on the conduit;
(g) generating a reference signal each time the reference point and conduit rotate past a detector during drilling;
(h) generating a signal each time the conduit rotates through the defined rotational orientation with respect to the downhole tool during drilling; and
(i) timing and comparing the occurrences of the reference signal and the signal in order to monitor the rotational orientation of the downhole tool.

8. A method of generating a correction factor accounting for sonic signal delay for use in determining the rotational orientation of a downhole tool on a rotatable conduit, comprising:
(a) establishing an initial rotational orientation of a downhole tool with respect to a reference point on a rotatable conduit;
(b) rotating the conduit at at least two rotational speeds and generating a signal when the rotating conduit is in a defined rotational orientation with respect to the downhole tool;
(c) monitoring the rotational orientation of the rotating conduit at which each of the signals of step (b) occur; and
(d) generating an indication of sonic signal delay for one or more rotational speeds from a calculation of linear slope of signals obtained from the at least two rotational speeds.

9. A method of generating a correction factor accounting for twist in a rotating conduit for use in determining the rotational orientation of a downhole tool on a rotatable conduit, comprising:

(a) establishing an initial rotational orientation of a downhole tool with respect to a reference point on a rotatable conduit;

(b) rotating the conduit at at least two weights applied to a drill bit interconnected to the rotatable conduit and generating a signal when the rotating conduit is in a defined rotational orientation with respect to the downhole tool;

(c) monitoring the rotational orientation and torque of the rotating conduit at which each of the signals of step (b) occur; and (d) generating an indication of twist for one or more weights from a calculation of a linear relationship between torque and signal shift.

10. A method for monitoring the rotational orientation of a downhole tool on a rotatable conduit and reorienting the tool when necessary, comprising the steps:

(a) establishing an initial rotational orientation of the downhole tool with respect to a reference point on the rotatable conduit;

(b) generating a signal each time the rotating conduit is in a defined rotational orientation with respect to the downhole tool during drilling;

(c) monitoring the rotational orientation of the rotating conduit at which the signal occurs; and (d) interrupting drilling and reorienting the downhole tool when monitoring indicates that reorientation is necessary.

* * * * *

UNITED STATES PATENT OFFICE

CERTIFICATE OF CORRECTION

Patent No. 5,103,919 Dated April 14, 1992

Inventor(s) Warren et al.

It is certified that error appears in the above-identified patent and that said Letters Patent is hereby corrected as shown below:

| | | |
|---|---|---|
| 7 | 46 | "reference signal 76" should read --reference signal 77--. |
| 10 | 38 | "orifice nd tool orifice" should read --orifice and tool orifice--. |

Signed and Sealed this

Fifteenth Day of March, 1994

Bruce Lehman

BRUCE LEHMAN

*Commissioner of Patents and Trademarks*

*Attest:*

*Attesting Officer*